US008142297B2

(12) United States Patent
Zhang

(10) Patent No.: US 8,142,297 B2
(45) Date of Patent: Mar. 27, 2012

(54) INFANT SWING APPARATUS AND METHOD OF OPERATING THE SAME

(75) Inventor: Da Liang Zhang, Kowloon (HK)

(73) Assignee: BP Children's Products HK Co., Limited, Kowloon (HK)

( * ) Notice: Subject to any disclaimer, the term of this patent is extended or adjusted under 35 U.S.C. 154(b) by 155 days.

(21) Appl. No.: 12/761,707

(22) Filed: Apr. 16, 2010

(65) Prior Publication Data

US 2010/0267457 A1 Oct. 21, 2010

Related U.S. Application Data

(60) Provisional application No. 61/169,727, filed on Apr. 16, 2009.

(51) Int. Cl.
*A63G 9/02* (2006.01)
*A63G 9/00* (2006.01)

(52) U.S. Cl. ..... 472/119

(58) Field of Classification Search ..... 472/118–125; 297/273, 274, 284; 5/93.1, 99.1, 101–103, 5/108, 109
See application file for complete search history.

(56) References Cited

U.S. PATENT DOCUMENTS

| | | | | |
|---|---|---|---|---|
| 6,386,986 | B1 * | 5/2002 | Sonner et al. | 472/119 |
| 6,511,123 | B1 * | 1/2003 | Sitarski et al. | 297/130 |
| 6,645,080 | B1 * | 11/2003 | Greger et al. | 472/118 |
| 6,932,709 | B1 * | 8/2005 | Gubitosi et al. | 472/118 |
| 7,189,164 | B1 * | 3/2007 | Paesang et al. | 472/118 |
| 2007/0060405 | A1 * | 3/2007 | Grossman et al. | 472/125 |
| 2010/0255919 | A1 * | 10/2010 | Kelly et al. | 472/118 |

* cited by examiner

*Primary Examiner* — Kien Nguyen
(74) *Attorney, Agent, or Firm* — David I. Roche; Baker & McKenzie LLP

(57) ABSTRACT

An infant swing is provided with a swing lock that can desirably block oscillating motion of the seat portion. The infant swing comprises a support frame and that has front and rear leg frames defining two lateral sides and respectively coupled with at least a hinge structure. At least one of the two lateral sides includes a swing arm pivotally coupled with the support frame via a pivot assembly. The swing lock is movably mounted with the pivot assembly, which includes a coupling hub provided with first and second engaging portions. The swing lock includes a latch bolt having a key movable relative to the coupling hub. When the key of the latch bolt engages with the second engaging portion, a distal end of the latch bolt is engaged through the hinge structure for locking rotation of the swing arm relative to the support frame.

20 Claims, 6 Drawing Sheets

INFANT SWING APPARATUS AND METHOD OF OPERATING THE SAME

CROSS-REFERENCE TO RELATED APPLICATION

This application claims priority to U.S. Provisional Application No. 61/169,727 filed on Apr. 16, 2009.

BACKGROUND OF THE INVENTION

1. Field of the Invention

The present invention generally relates to swing apparatuses, and more particularly to an infant swing apparatus and a method for operating the infant swing.

2. Description of the Related Art

It is well known that regular swing motion can be helpful to comfort a young child or baby, e.g., when the child cries or for helping the child to sleep. Currently, there is a variety of products available on the market that can provide such function, such as infant swings, rocking chairs, cradles and so on.

An infant swing usually includes a support frame, a seat portion, and swing arms connected between the seat portion and the support frame. Swinging motion of the seat portion can be driven either manually or by an electrical motor coupled with the swing arms. However, when no swinging motion is desired, the seat portion generally cannot rest stationary in a stable manner owing to the pivot links between the swing arms and the support frame.

Therefore, there is a present need for an infant swing that can allow the seat portion to rest stationary in a stable manner, and address at least the foregoing issues.

SUMMARY

The present application describes an infant swing apparatus and method of operating the same that can desirably block oscillating motion of the infant swing apparatus. In one embodiment, the infant swing apparatus comprises a support frame and a seat portion. The support frame includes a front leg frame and a rear leg frame respectively coupled with a hinge structure having an opening, and defines two sides of the infant swing between which the seat portion is assembled. At least one of the two sides includes a swing arm having a lower end portion that hangs the seat portion. A top end portion of the swing arm is coupled with the support frame via a pivot assembly at a location adjacent to the hinge structure, wherein the pivot assembly includes a first engaging portion and a second engaging portion. A swing lock is also provided in the pivot assembly, wherein the swing lock includes a latch bolt having an operating end, an engaging end opposite the operating end, and a key between the operating end and the engaging end. The key is movable to engage with either of the first engaging portion and the second engaging portion. When the key engages with the second engaging portion, the engaging end is positioned through the opening of the hinge structure. When the key engages with the first engaging portion, the engaging end is out of the opening of the hinge structure.

The present application also describes a method of operating the swing apparatus. In one embodiment, the method comprises pulling the latch bolt from a first position where the key is engaged with the first engaging portion to a second position where the key is disengaged from the first engaging portion, turning the latch bolt to displace the key to a position aligned with the second engaging portion, and moving the latch bolt to engage the key with the second engaging portion and cause a distal end portion of the latch bolt to extend out of the coupling hub and engage through the opening of the hinge structure.

In a variant embodiment, the method comprises turning the latch bolt to disengage the key from the first engaging portion of the coupling hub, rotating the latch bolt to displace the key to a position aligned with the second engaging portion of the coupling hub, and causing the key to engage with the second engaging portion and a distal end portion of the latch bolt to extend out of the coupling hub for engaging through the opening of the hinge structure.

In another embodiment, the method comprises turning the latch bolt to disengage the key from the first engaging portion of the coupling hub, rotating the latch bolt to displace the key to a position aligned with the second engaging portion of the coupling hub, and causing the key to engage with the second engaging portion and a distal end portion of the latch bolt to extend out of the coupling hub for engaging through the opening of the hinge structure.

At least one advantage of the apparatus and method described herein is the ability to desirably lock the swing arms with the support frame of the infant swing. As a result, swinging motion can be blocked, and the seat portion can lie stationary in a stable manner.

DETAILED DESCRIPTION OF THE EMBODIMENTS

The present application describes an infant swing apparatus and method of operating the same that can desirably block oscillating motion of the infant swing apparatus.

Figure 1:
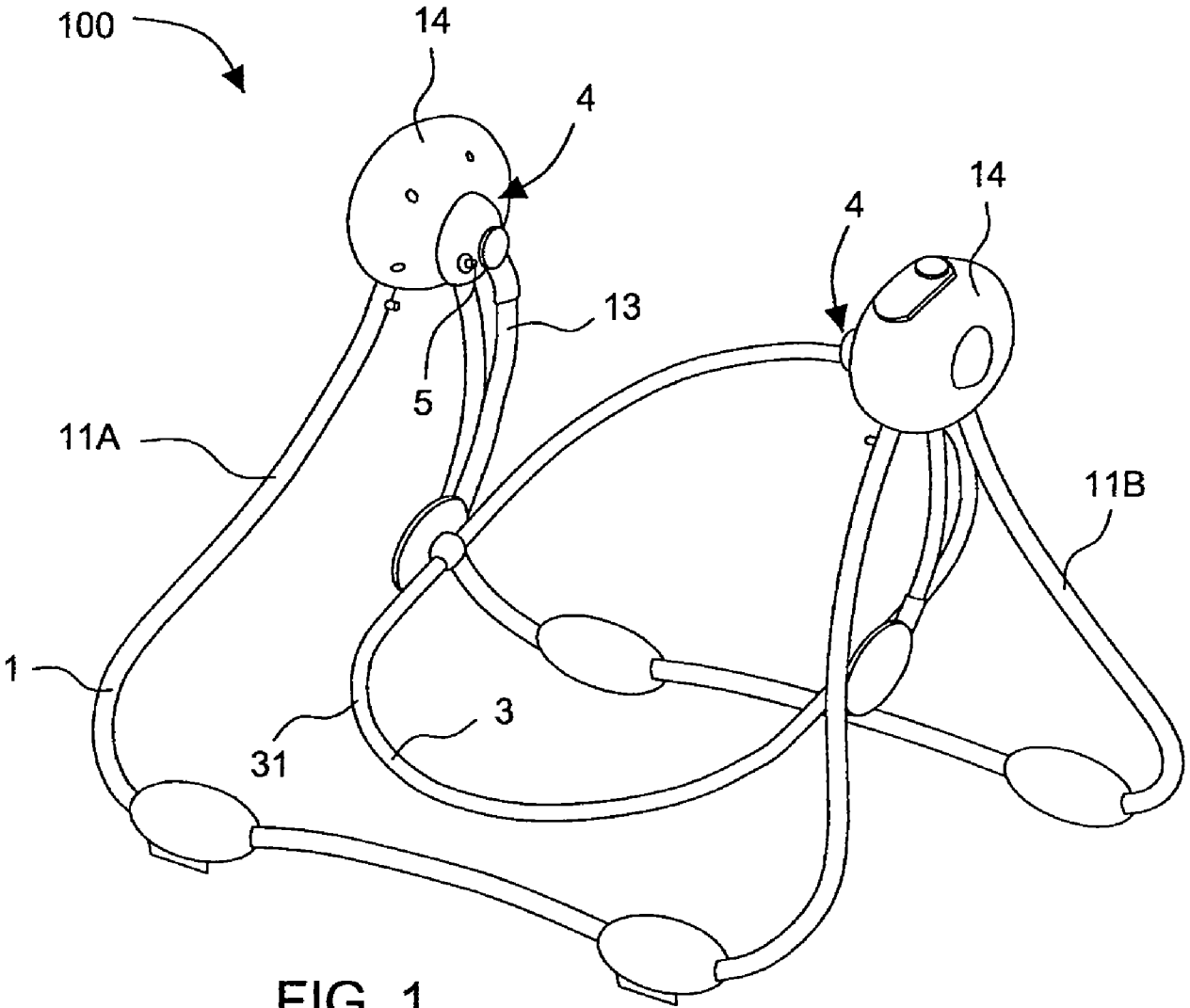
FIG. 1 is a perspective view illustrating an embodiment of an infant swing apparatus.
Figure 2:
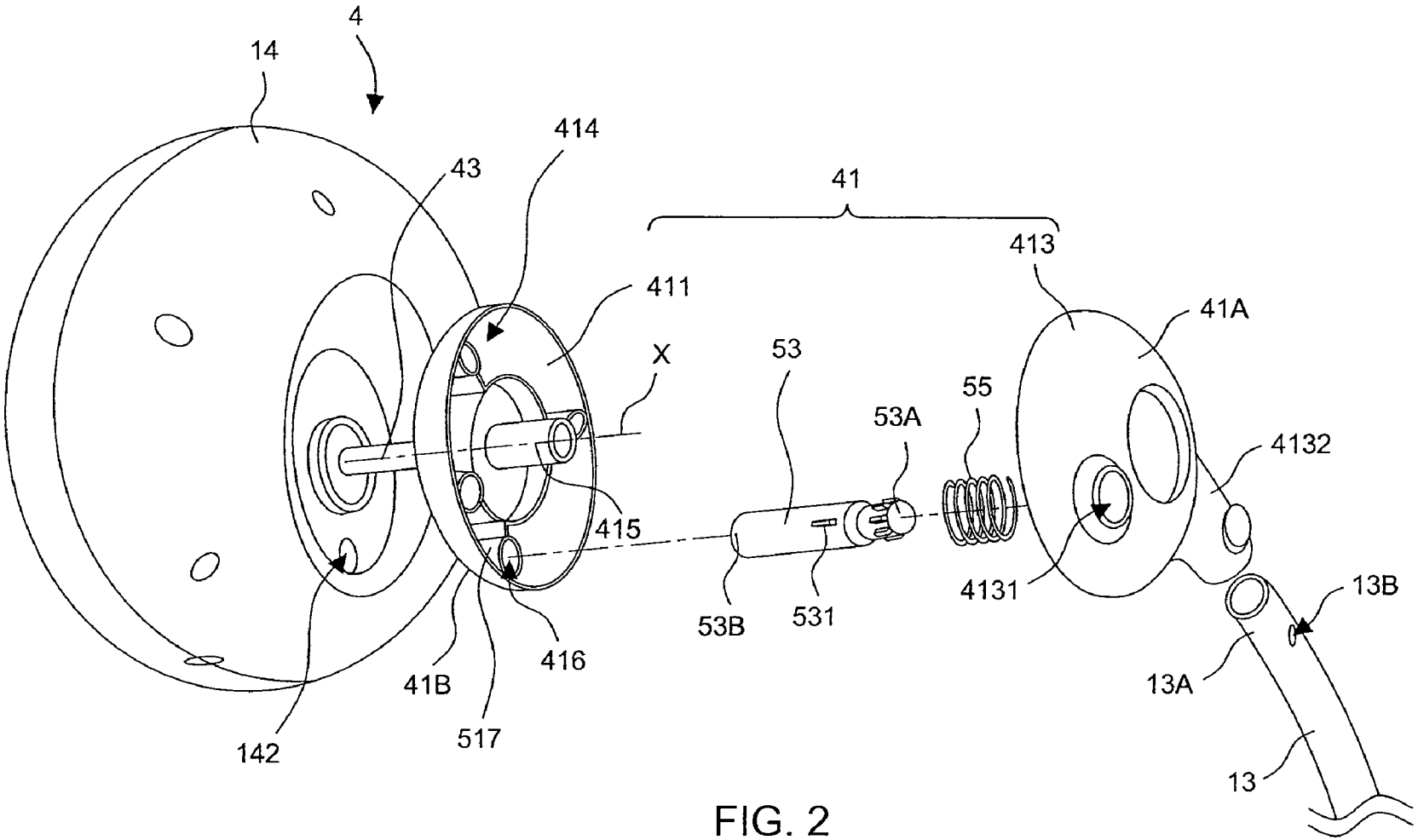
FIG. 2 is an exploded view showing the pivot assembly and swing lock shown in FIG. 1.

FIGS. 1 and 2 are schematic views illustrating one embodiment of an infant swing apparatus 100. The infant swing apparatus 100 can comprise a support frame 1, and a seat portion 3. The support frame 1 includes a front leg frame 11A, a rear leg frame 11B, a folding hinge structure 14 mounted on each of a left and right side of the support frame 14, and two swing arms 13. Left and right top ends of the front leg frame 11A are respectively coupled with the folding hinge structures 14, and so do left and right top ends of the rear leg frame 11B. In one embodiment, each of the folding hinge structures 14 can be constructed as a pivot link that can pivotally couple the front leg frame 11A and the rear leg frame 11B for facilitating folding and unfolding operations of the support frame 1 by rotation around the hinge structures 14. A top end of each swing arm 13 is connected adjacent with each of the folding hinge structures 14 via a pivot assembly 4, respectively. The seat portion 3 can include a tubular seat frame 31 having a generally elliptical shape. The seat frame 31 can be mounted on an inner side of the support frame 1, secured with a lower end of each swing arm 13. One or more of the pivot assembly 4 can be mounted with a movable swing lock 5 having a locked state and an unlocked state. When the swing lock 5 is in a locked state, rotation of the swing arm 13 about the rotation axis of the pivot assembly 4 is blocked. When the swing lock 5 is in an unlocked state, rotation of the swing arm 13 about the rotation axis of the pivot assembly 4 is permitted. It will be appreciated that the swing lock 5 may be provided on one or two of the pivot assembly 4.

Figure 3:
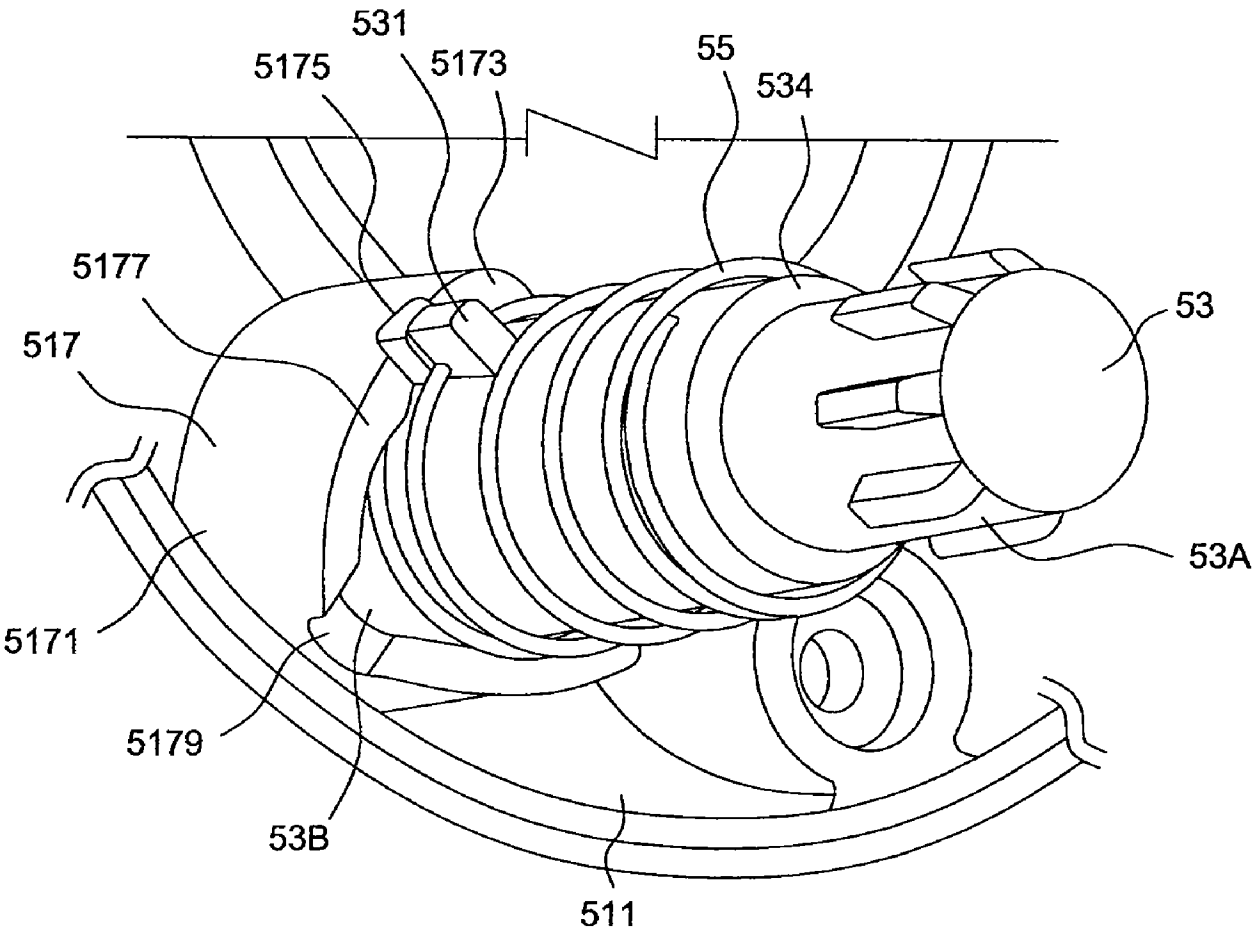
FIG. 3 is a schematic view showing the swing lock in an unlocked state.

FIGS. 2 and 3 are schematic views illustrating embodiments of the pivot assembly 4 and swing lock 5. More specifically, FIG. 2 is an exploded view showing the pivot assembly 4 and the swing lock 5, and FIG. 3 is an enlarged view of the swing lock 5. As shown in FIGS. 2 and 3, the pivot assembly 4 can include a coupling hub 41 secured with a top end portion 13A of one swing arm 13, and an axle 43 fixed on the hinge structure 14 and adapted to pivotally assemble through the coupling hub 41. The coupling hub 41 can include a first casing 411 and a second casing 413. The first and second casing 411 and 413 can be assembled with each other to form an inner space 414 of the coupling hub 41. An inner surface of the first casing 411 include a shaft sleeve 415 corresponding to the rotation axis of the pivot assembly 4 defined by the axle 43, and an opening 416 disposed eccentric from the shaft sleeve 415. The second casing 413 has an opening 4131 corresponding to the opening 416 through the first casing 411. A peripheral portion of the second casing 413 also includes a sleeve 4132 adapted to accommodate a top end portion 13A of the swing arm 13. More specifically, the top end portion 13A of the swing arm 13 can be passed through the sleeve 4132 of the second casing 413 to be fixedly secured in the inner space 414 of the coupling hub 41. The axle 43 can be then passed through the shaft sleeve 415 and an opening 13B formed through the top end portion 13A of the swing arm 13 for pivotally mounting the coupling hub 41 and the swing arm 13 on the hinge structure 14. Accordingly, the coupling hub 41 and swing arm 13 can perform oscillating motion around the rotation axis X defined by the axle 43. It will be readily appreciated that aside the foregoing construction, the swing arm 13 can also be mounted with the sleeve 4132 via other assembly methods.

Referring again to FIG. 2, the swing lock 5 is movably mounted with the pivot assembly 4. The swing lock 5 can include a latch bolt 53 and a spring 55. The latch bolt 53 can be movably mounted in the coupling hub 41 at a position eccentric from the rotation axis X. The latch bolt 53 can have a generally cylindrical shape, and is movable along a displacement axis substantially parallel with the rotation axis X. An operating end 53A of the latch bolt 53 passes through the opening 4131 and is exposed on an outer surface 41A of the coupling hub 41. A distal engaging end 53B of the latch bolt 53 opposite the operating end 53A can pass through the opening 416 of the first casing 411, and is exposed on another outer surface 41B of the coupling hub 41 opposite the outer surface 41A. In this manner, the engaging end 53B of the latch bolt 53 can extend outward through the opening 416 of the first casing 411 and engage through an opening 142 provided on the hinge structure 14 for blocking rotation of the coupling hub 41 and swing arm 13 relative to the support frame 1. As shown, the opening 142 may be typically formed through a housing of the hinge structure 14. Moreover, a portion of the latch bolt 53 between the operating end 53A and the engaging end 53B can also include a key 531 protruding radial from the latch bolt 53. The key 531, formed as a radial protrusion projecting from the latch bolt 53, can engage with a position indexer 517 provided on the first casing 411 (as shown FIG. 3). The spring 55 is assembled around the latch bolt 53, one end of the spring 55 abutting an inner surface of the second casing 413, the other end of the spring 55 being secured with the key 531. It will be appreciated that aside the foregoing construction, the end of the spring 55 can also be secured with the latch bolt 53 by other methods, e.g., disposed in abutment against the key 531.

As shown in FIG. 3, the position indexer 517 can be formed by a raised portion 5171 disposed around the opening 416 and protruding from an inner surface of the first casing 411. A top edge 5173 of the raised portion 5171 includes a first engaging portion 5175, a slopped surface 5177, and a second engaging portion 5179. In one embodiment, the first and second engaging portions 5175 and 5179 can be recesses formed on the top edge 5173, disposed at different radial directions relative to the displacement axis of the latch bolt 53. The slopped surface 5177 is disposed between the first and second engaging portions 5175 and 5179, such that the first engaging portion 5175 is located at a position higher than the second engaging portion 5179 relative to the inner surface of the first casing 411. In other words, the distance from the inner surface of the first casing 411 to the first engaging portion 5175 is greater than the distance from the inner surface of the first casing 411 to the second engaging portion 5179. As shown, the latch bolt 53 is also pivotally mounted through the openings 416 and 4131 in the coupling hub 41. Accordingly, the latch bolt 53 can also be rotated around its displacement axis (i.e., approximately perpendicular to the first and second casing 411 and 413 and parallel with the rotation axis X) for permitting the key 531 to selectively engage with either of the first engaging portion 5175 and second engaging portion 5179 (FIG. 3 exemplary illustrates the key 531 engaged with the first engaging portion 5175). In addition, the latch bolt 53 also has a shoulder 534 adjacent to the operating end 53A. The shoulder 534 has a width greater than the opening 4131 for preventing the latch bolt 53 from moving out of the coupling hub 41 when the operating end 53A is pulled on the outer surface 41A of the coupling hub 41. It will be appreciated that while the illustrated embodiment forms the key 531 as a protruding rib and the first and second engaging portions 5175 and 5179 as recesses, alternate embodiments can also form the key as a recess and the first and second engaging portions as protruding ribs.

Figure 4:
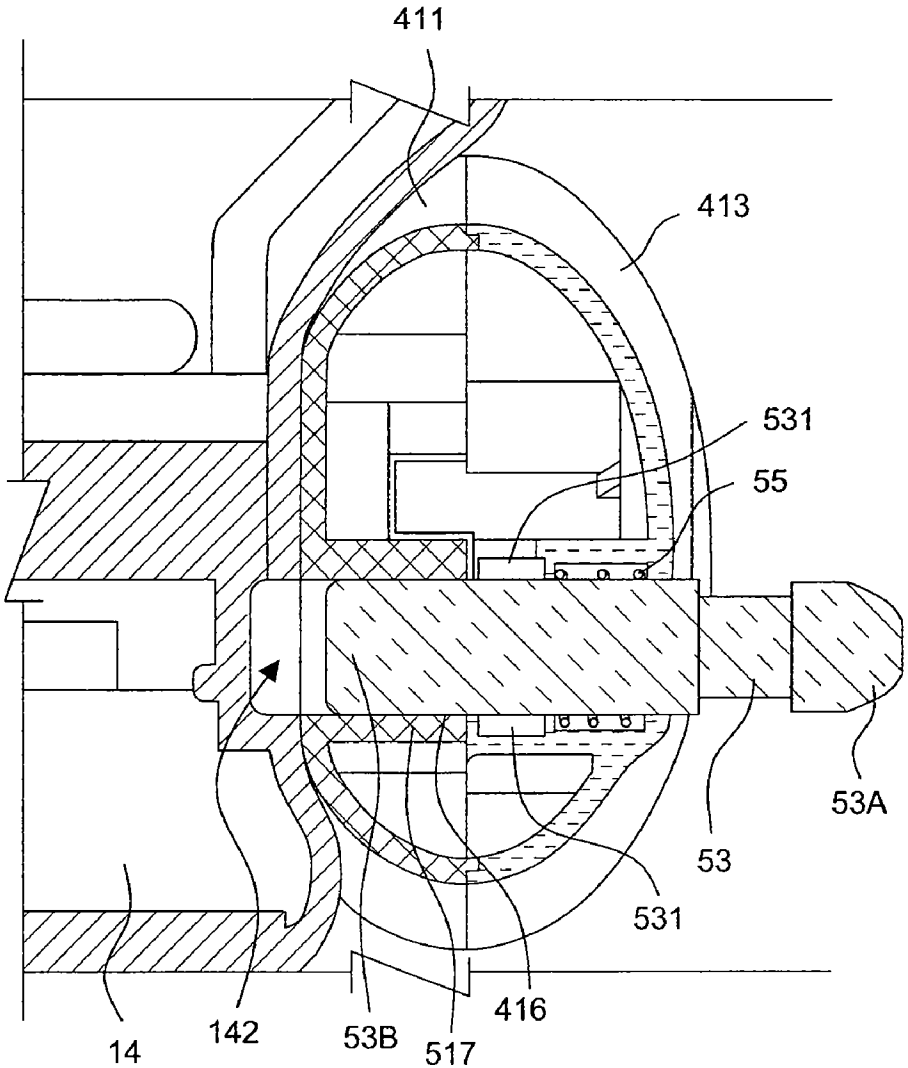
FIG. 4 is a cross-sectional view of the swing lock in the unlocked state.

As shown in FIGS. 3 and 4, when the swing lock 5 is in an unlocked state, the key 531 of the latch bolt 53 engages with the first engaging portion 5175, and the engaging end 53B of the latch bolt 53 is retracted toward the interior of the coupling hub 41 out of engagement with the opening 142 of the hinge structure 14. Accordingly, rotation of the coupling hub 41 and associated swing arm 13 around the rotation axis X relative to the support frame 1 and hinge structure 14 is permitted.

Figure 5:
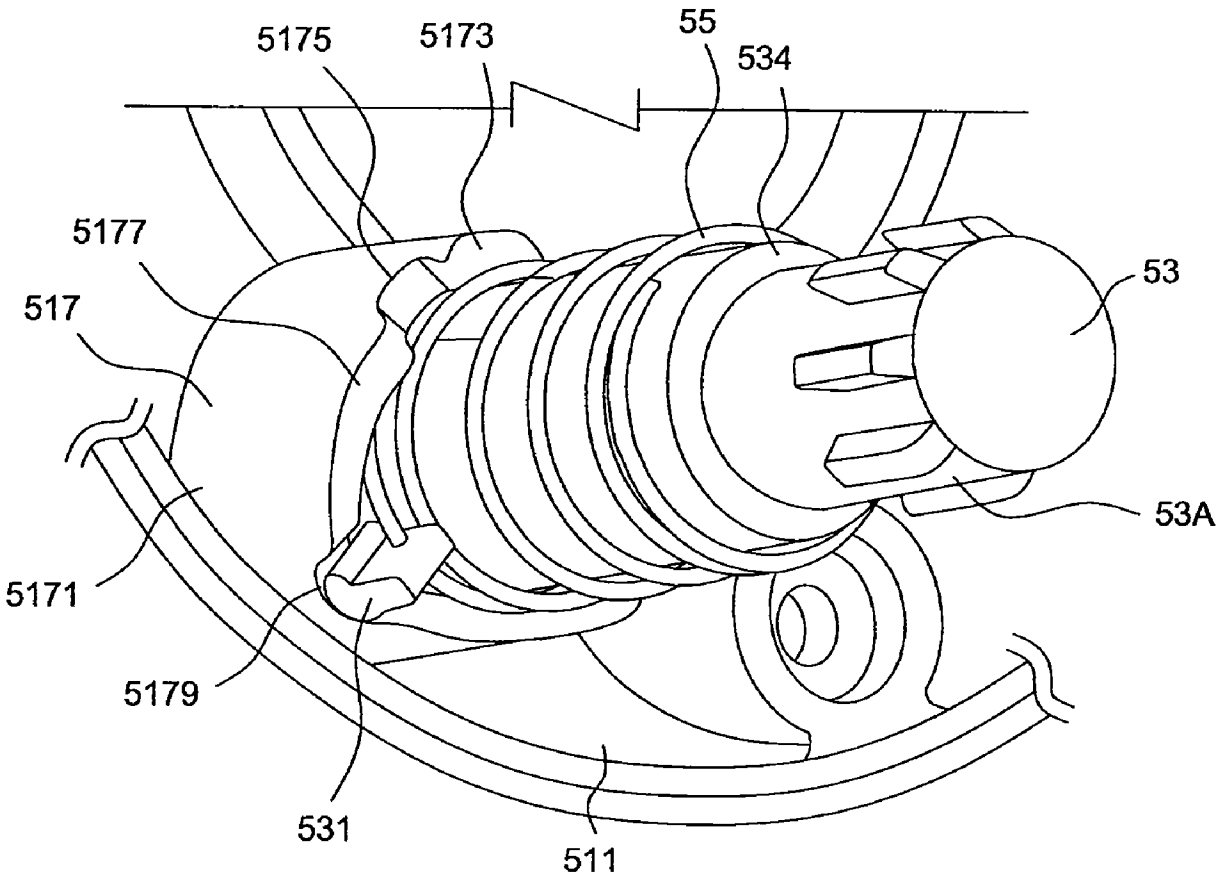
FIG. 5 is a schematic view showing the swing lock in a locked state.
Figure 6:
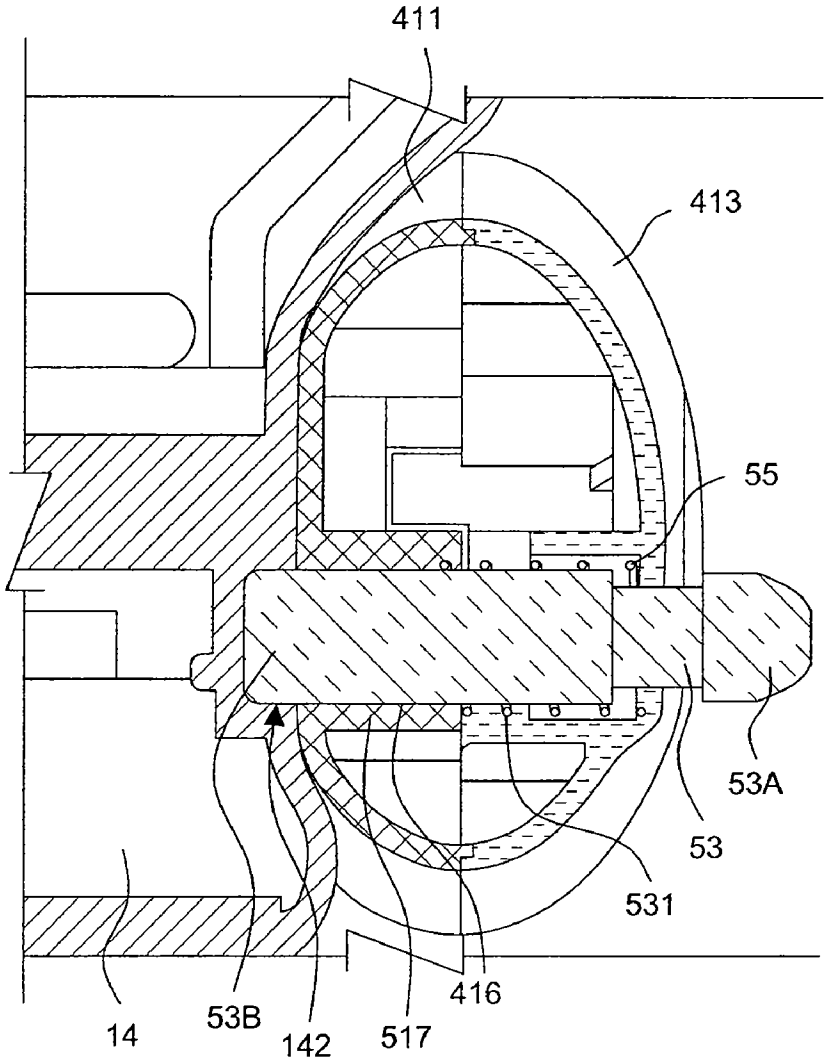
FIG. 6 is a cross-sectional view showing the swing lock in the locked state.

FIGS. 5 and 6 schematically illustrate an operation for turning the swing lock 5 from the unlocked state to the locked state for locking the swing arm 13 with the support frame 1. First, the latch bolt 53 is pulled in a direction away from the hinge structure 14 so that the key 531 of the latch bolt 53 disengages from the first engaging portion 5175. The latch bolt 53 can be then rotated in a direction that displaces the key 531 toward the second engaging portion 5179. Once the key 531 is aligned with the second engaging portion 5179, the latch bolt 53 then can be released. Biased by the spring 55, the latch bolt 53 can accordingly move toward the hinge structure 14, such that the key 531 of the latch bolt 53 engages with the second engaging portion 5179 of the position indexer 517 and the engaging end 53B of the latch bolt 53 extends out of the coupling hub 41 and engages through the opening 142 of the hinge structure 14. Accordingly, rotation of the coupling hub 41 and associated swing arm 13 around the rotation axis X can be blocked.

It is worth noting that the aforementioned step of pulling the latch bolt 53 in a direction away from the hinge structure 14 is not necessarily required. Indeed, the latch bolt 53 can also be directly rotated, such that the key 531 disengages from the first engaging portion 5175 and then moves in contact with the slopped surface 5177 toward the second engaging portion 5179 via the biasing action of the spring 55. Once the key 531 reaches the second engaging portion 5179, the engaging end 53B of the latch bolt 53 can extend out of the coupling hub 41 and engages through the opening 142 of the hinge structure 14 by the biasing action of the spring 55. Rotation of the swing arm 13 and seat portion 3 relative to the hinge structure 14 and support frame 1 can be thereby blocked.

As described above, when the key 531 and the engaging end 53B of the latch bolt 53 respectively engage with the second engaging portion 5179 and the opening 142, the swing arm 13 can be locked with the support frame 1, and swinging motion of the swing arm 13 and seat portion 3 relative to the support frame 1 can be blocked. Once the seat portion 3 is locked in rotation, a child can then be placed in the seat portion 3 in a safe manner. While the aforementioned embodiments are exemplary applied in an infant swing apparatus, it will be readily appreciated that constructions and methods described herein can be suitable for any products in general, such as a rocking chair, cradle and the like.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An infant swing apparatus comprising:

a support frame, including a front leg frame and a rear leg frame defining two sides of the infant swing and respectively coupled with a hinge structure, at least one of the two sides including a swing arm;

a seat portion assembled between the two sides of the infant swing, wherein the seat portion is hung from a lower end portion of the swing arm;

a pivot assembly coupling a top end portion of the swing arm with the support frame at a location adjacent to the hinge structure, wherein the pivot assembly includes a first and second engaging portion; and a swing lock movably mounted with the pivot assembly, wherein the swing lock includes a latch bolt having an operating end, an engaging end opposite the operating end, and a key between the operating end and the engaging end, wherein the latch bolt is movable to cause the key to engage with either of the first and second engaging portion, when the key engages with the second engaging portion, the engaging end is positioned through an opening of the hinge structure; when the key engages with the first engaging portion, the engaging end is disengaged from the opening of the hinge structure.

2. The infant swing apparatus according to claim 1, wherein the swing lock further includes a spring assembled with the latch bolt, a first end of the spring secured with the latch bolt, and a second end of the spring abutting against an inner surface of the pivot assembly, whereby the latch bolt is biased by the spring to engage with either of the first and second engaging portion.

3. The infant swing apparatus according to claim 1, wherein the pivot assembly includes a coupling hub fixedly secured with the swing arm, and an axle coupled with the hinge structure, the coupling hub including a first casing and a second casing assembled with each other to form an inner space, one side of the second casing has a sleeve adapted to accommodate a top end portion of the swing arm.

4. The infant swing apparatus according to claim 3, wherein the first and second casings respectively have a first and second opening, and the latch bolt is movably mounted in the coupling hub, the operating end of the latch bolt extending through the second opening of the second casing to expose on a first outer side of the coupling hub, and the engaging end of the latch bolt being operable to travel through the first opening of the first casing to extend outward from a second outer side of the coupling hub.

5. The infant swing apparatus according to claim 4, wherein the latch bolt further includes a shoulder portion that has a width greater than the second opening.

6. The infant swing apparatus according to claim 4, wherein the first casing includes a raised portion around the first opening, the first and second engaging portions being formed on a top edge of the raised portion.

7. The infant swing apparatus according to claim 6, wherein the raised portion further includes a slopped surface between the first and second engaging portion.

8. The infant swing apparatus according to claim 6, wherein a distance between the first engaging portion and the inner surface of the first casing is greater than a distance between the second engaging portion and the inner surface of the first casing.

9. The infant swing apparatus according to claim 6, wherein the first and second engaging portions are recesses formed on the top edge of the raised portion.

10. The infant swing apparatus according to claim 9, wherein the key includes a radial protrusion projecting from the latch bolt.

11. The infant swing apparatus according to claim 1, wherein the latch bolt is operable to move along a displacement axis substantially parallel with a rotation axis of the pivot assembly.

12. The infant swing apparatus according to claim 11, wherein the first and second engaging portions are disposed at different radial directions relative to the displacement axis.

13. The infant swing apparatus according to claim 12, wherein the latch bolt is further operable to rotate around the displacement axis for engaging with either of the first and second engaging portion.

14. A method of operating an infant swing, wherein the infant swing comprises a support frame and a seat portion, the support frame includes front and rear leg frames defining two lateral sides of the infant swing and respectively coupled with a hinge structure having an opening, at least one of the two lateral sides including a swing arm pivotally coupled with the support frame via a pivot assembly for hanging the seat portion, the method comprising:

providing a swing lock movably mounted with the pivot assembly, wherein the pivot assembly includes a coupling hub provided with first and second engaging portions, and the swing lock includes a latch bolt having a radial protruding key movable relative to the coupling hub;

pulling the latch bolt from a first position where the key is engaged with the first engaging portion to a second position where the key is disengaged from the first engaging portion;

turning the latch bolt to displace the key to a position aligned with the second engaging portion; and moving the latch bolt to cause the key to engage with the second engaging portion and a distal end portion of the latch bolt to extend out of the coupling hub and engage through the opening of the hinge structure.

15. The method according to claim 14, further comprising:

providing a spring assembled around the latch bolt, wherein a first end of the spring abuts against a portion of the bolt and a second end of the spring abuts against an inner surface of the coupling hub, the latch bolt being biased by the spring to engage with either of the first and second engaging portion.

16. The method according to claim 14, wherein the step of pulling the latch bolt is performed along a displacement axis substantially parallel with a rotation axis of the pivot assembly.

17. The method according to claim 16, wherein the step of turning the latch bolt includes rotating the latch bolt around the displacement axis.

18. A method of operating an infant swing, wherein the infant swing comprises a support frame and a seat portion, the support frame includes front and rear leg frames defining two lateral sides of the infant swing and respectively coupled with at least a hinge structure having an opening, at least one of the two lateral sides including a swing arm pivotally coupled with the support frame via a pivot assembly for hanging the seat portion, the method comprising:

providing a swing lock movably mounted with the pivot assembly, wherein the pivot assembly includes a coupling hub provided with first and second engaging portions, and the swing lock includes a latch bolt having a radial protruding key movable relative to the coupling hub;

turning the latch bolt to disengage the key from the first engaging portion of the coupling hub;

rotating the latch bolt to displace the key to a position aligned with the second engaging portion of the coupling hub; and causing the key to engage with the second engaging portion and a distal end portion of the latch bolt to extend out of the coupling hub for engaging through the opening of the hinge structure.

19. The method according to claim 18, further comprising:

providing a slopped surface between the first and second engaging portion, wherein the step of rotating the latch bolt causes the key to slide in contact with the slopped surface toward the second engaging portion.

20. The method according to 19, wherein the step of rotating the latch bolt further causes the latch bolt to slide along a displacement axis substantially parallel with a rotation axis of the pivot assembly.

* * * * *